United States Patent [19]

Lo

[11] Patent Number: 4,747,512

[45] Date of Patent: May 31, 1988

[54] TRANSPORTATION PACKAGING FOR LIQUIDS

[76] Inventor: Kin K. Lo, 56 Chartland Boulevard South, Scarborough, Ontario, Canada, M1S 2R4

[21] Appl. No.: 64,051

[22] Filed: Jun. 19, 1987

[51] Int. Cl.[4] ..... B65D 25/00

[52] U.S. Cl. ..... 220/444; 220/415; 206/524.1; 250/506.1

[58] Field of Search ..... 220/415, 421, 444, 466; 206/524.1, 524.4, 524.5; 250/506.1, 507.1

[56] References Cited

U.S. PATENT DOCUMENTS

| | | | |
|---|---|---|---|
| 3,414,727 | 12/1968 | Bonilla | 250/506.1 |
| 3,432,666 | 3/1969 | Nash et al. | 206/524.1 X |
| 3,466,662 | 9/1969 | Blum | 250/506.1 |
| 3,754,140 | 9/1973 | Beierle . | |
| 4,100,860 | 7/1978 | Gablin et al. . | |
| 4,116,337 | 9/1978 | Backus . | |
| 4,560,069 | 12/1985 | Simon | 250/506.1 X |
| 4,574,454 | 3/1986 | Dyson . | |
| 4,588,088 | 5/1986 | Allen | 220/444 X |
| 4,626,382 | 12/1986 | Stritzke et al. | 250/506.1 |
| 4,636,645 | 1/1987 | Kessinger | 250/506.1 |
| 4,672,213 | 6/1987 | Stoll et al. | 250/506.1 |

OTHER PUBLICATIONS

K. K. Lo et al., "Ontario Hydro Tritiated Heavy Water Transport Package", Jun. 20, 1986, IAEA International Symposium, Davos, Switzerland.

*Primary Examiner*—Steven M. Pollard

[57] ABSTRACT

An overpack for a vessel for containing hazardous liquid comprising a circular lid seating on a hollow cylindrical body. The lid and body of each of outer welded shell construction is filled with a core of heat insulative filler such as rigid polyurethane foam. The upper edges of the inner and outer cylindrical side walls of the body are each welded to a respective relatively heavy and substantially rigid ring which allows the side walls together with their associated bottom walls to be suspended accurately concentric with one another until the structure is rigidified by welding on of a cap connecting the rings together. This allows accurate reproduction of the required standard design for the overpack meeting the requirements for survival of drop, impact and fire tests with the structure remaining as a containment for the hazardous liquid.

13 Claims, 5 Drawing Sheets

TRANSPORTATION PACKAGING FOR LIQUIDS

The present invention relates to a cylindrical overpack for protection of a vessel for holding radio-active or like hazardous materials, for example tritiated heavy water, during transport, for example from a nuclear generating station to a facility at which the heavy water may be processed to remove the radioactive tritium therefrom, to a packaging comprising the vessel and its overpack, and to a method of fabricating the overpack.

It is required that the packaging for transport of such materials should survive drop, impact, puncture and fire tests without leakage of the materials to the surroundings.

An advantageous form of packaging for this purpose comprises an overpack comprising an inner and an outer cylindrical shell, with the space between the inner and the outer shells filled with heat insulative fill material, e.g. polyurethane foam, and an inner cask or vessel disposed within the overpack. The cylindrical construction lends itself to structural analysis, using, for example, finite element computer analysis programs, to arrive at a structure capable of meeting the requirements referred to above. Since destructive testing of each packaging manufactured would be undesirable or impracticable, it is necessary to ensure that each packaging manufactured is as far as possible an accurate reproduction of the model or desired form of structure. This has been difficult to achieve with known designs of which the applicant is aware. The applicant has found, for example, that there are difficulties in maintaining the inner cylindrical wall of the packaging precisely concentric with the outer wall during all stages of manufacture.

The present invention provides a cylindrical overpack for protection of a vessel for holding radioactive or like hazardous materials during transport, comprising a circular lid having an upper and a lower circular wall, a cylindrical edge member welded at its upper and lower ends to the upper and lower walls, respectively, and heat insulative filler material disposed in the space therebetween, and a cylindrical hollow body on which the lid is secured, having concentric inner and outer cylindrical walls defining an annular space therebetween, with said outer wall of greater axial extent than said inner wall and an inner and an outer circular bottom wall welded to the lower edges of inner and outer cylindrical walls, respectively, and with said outer bottom wall offset downwardly from the inner bottom wall to define a lower space therebetween, outer and inner substantially rigid concentric ring members welded to an upper edge of the outer and of the inner cylindrical walls, respectively, and each of a rectangular cross section of axial and transverse dimensions each greater than the wall thickness of the cylindrical wall to which it is welded, an annular cap member extending between and welded at its opposite edges to said outer and inner ring members, respectively, and heat insulative filler material disposed in said annular and lower spaces.

With this arrangement, manufacture of the overpack with the outer cylindrical wall accurately concentric with the inner wall is much facilitated. The outer and inner substantially rigid rings may be employed as reference members, and, after having the inner and the outer cylindrical walls welded thereto, may be maintained accurately concentric with one another until the relatively flexible inner and outer walls are secured together by completion of the cylindrical structure. Desirably, the heat insulative filler material is a rigid resin foam which adds rigidity to the structure and anchors the inner and outer walls together once it fills the space between them.

An example of an overpack in accordance with the invention and of a container employing the overpack are described in more detail below, by way of example only, with reference to the accompanying drawings in which.

Figure 1:
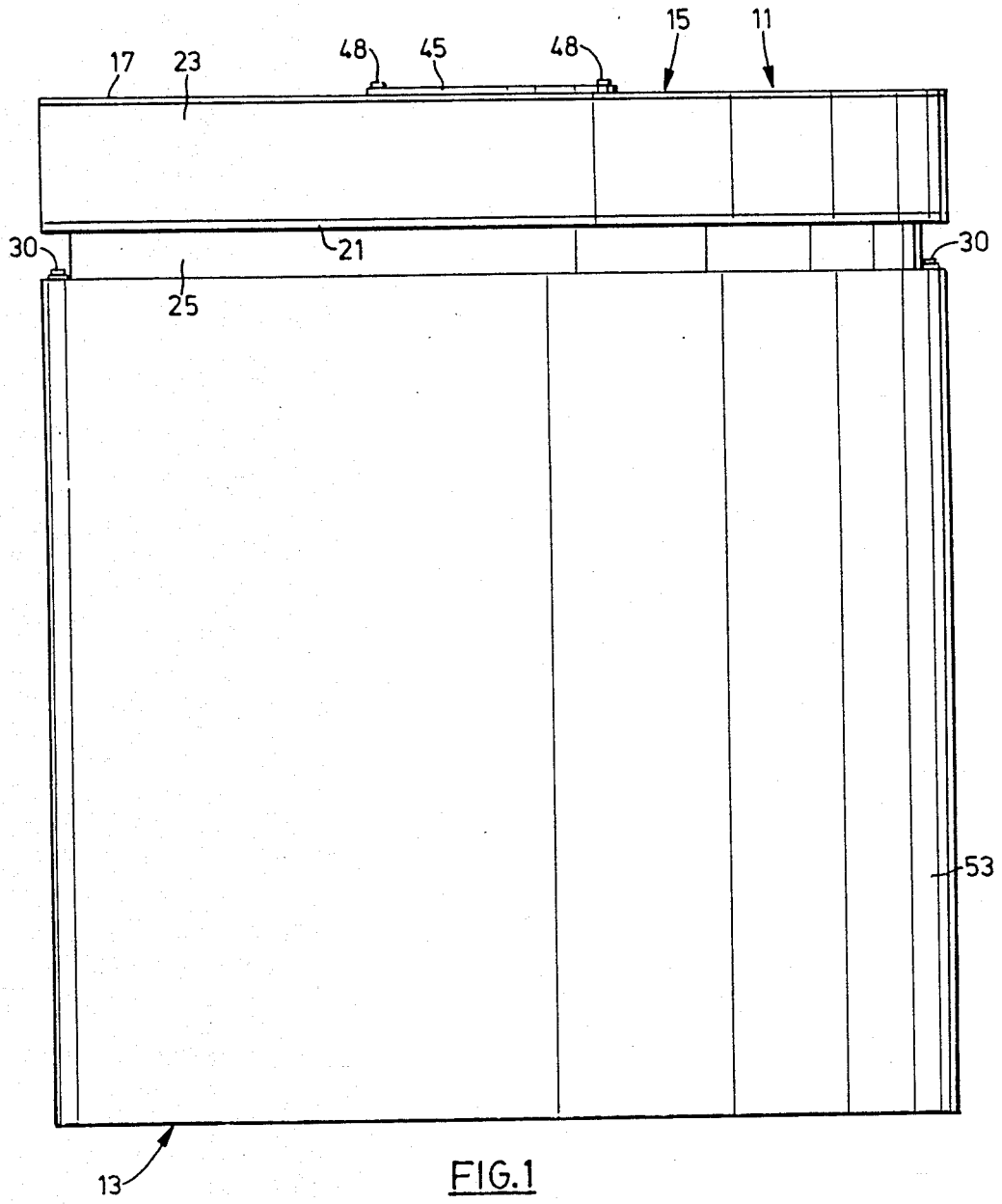
FIG. 1 shows a side view of an overpack in accordance with the invention.

Referring to the drawings, an overpack 11 comprises a hollow cylindrical body 13 and a circular lid 15.

Figure 4:
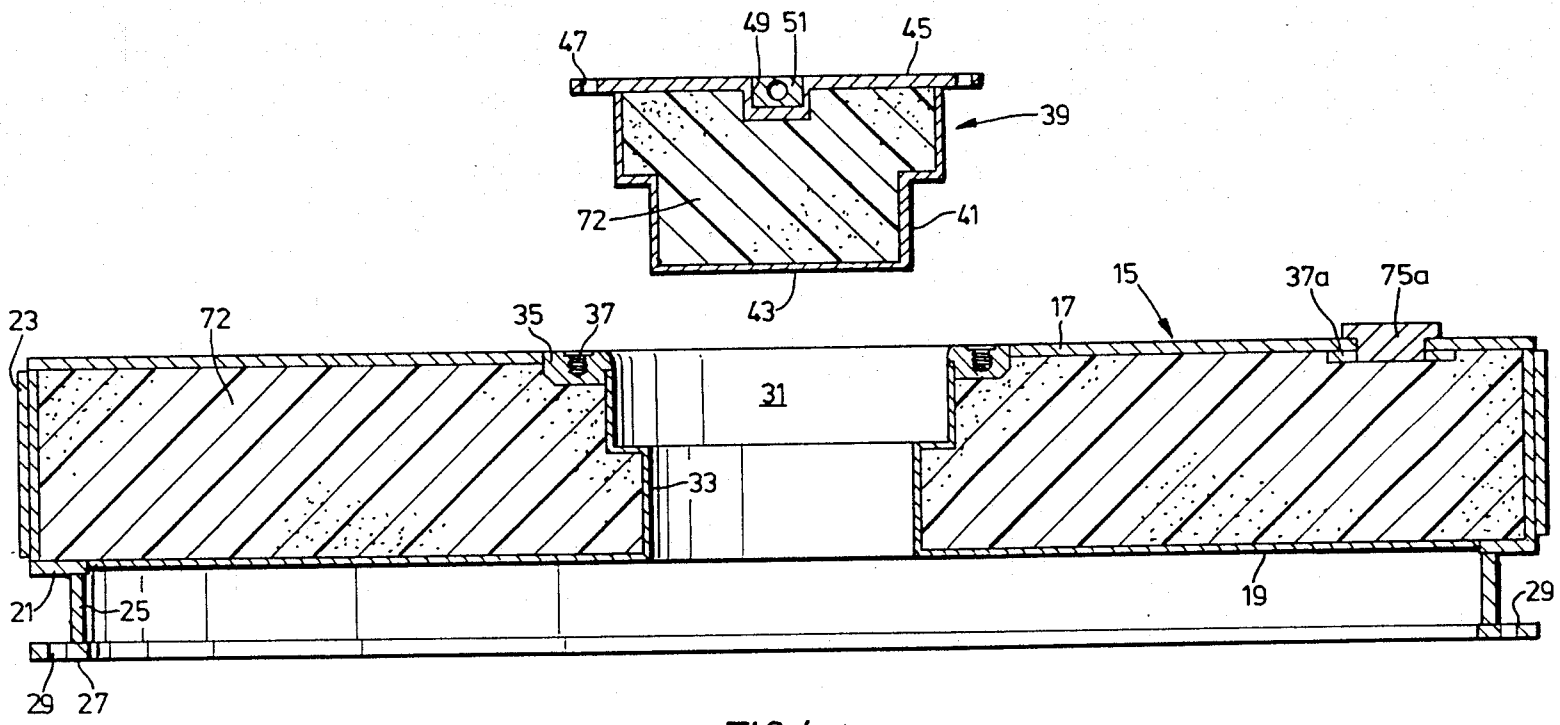
FIG. 4 is a cross section on an enlarged scale of the lid of the overpack and the central plug thereof.

As seen in FIG. 4, the lid comprises an upper circular wall 17 and a lower circular wall 19 each of sheet metal. The wall 19 is relatively thin, since it is to be disposed on the inside, and at its edge is welded to a horizontal annular relatively thick sheet metal wall rim 21. A cylindrical sheet metal edge member 23 is welded at its upper and lower edges to the upper wall 17 and to the rim 21, respectively.

The lid 15 seats on the body 13 through a downwardly depending flange 25 welded at its upper edge to the rim 21 of the wall 19, and through a horizontal, radially extending annular flange 27 welded to the lower edge of the flange 25. The flange 27 is formed with a series of bores 29 through it at uniformly circumferentially spaced intervals to receive threaded studs 30 for attachment of the lid to the body 13.

In order to allow access through the overpack 11 without needing to remove the lid 15 from the body 13, a generally circular opening 31 is formed through the lid and is defined by an inwardly stepped generally circular wall 33, forming a wide upper opening leading through a seating step or shoulder to a lower narrower opening. The upper edge of wall 33 is welded to a relatively heavy metal ring 35 welded at its outer edge to the periphery of a circular opening in the upper wall 17 of the lid, and formed with a series of bores 37 at uniform circumferential intervals. A generally cylindrical plug 39 having an inwardly stepped configuration matching the opening 31 normally seats in the opening to close the lid and comprises a stepped side wall 41 welded at its lower edge to a circular bottom wall 43 and at its top edge to the underside of a relatively thick circular plate 45 which seats on the upper side of the ring 35 and has bores 47 through its perimeter through which threaded studs 48 can be passed to be threaded into each bore 37, thus removably securing the plug 39 in the opening 31. The plate 45 may have a central depression 49 in its upper surface in which may be secured an apertured lug 51 which can be engaged by a hook of lifting equipment to assist in lifting the plug 39 from the opening 31 or in replacing it therein.

In the preferred form, all the metal components of the packaging, including all the walls, rings, flanges, etc. described above as well as those elements described below, and forming the shell of the overpack structure, as well as the inner lid and inner cask or containment vessel, and including all studs and tubes, are fabricated from stainless steel. One advantage of the use of stainless steel is that it is readily possible to decontaminate its surface in the event of a spill of radioactive liquid thereon, by grinding and polishing the surface. A further advantage is that stainless steel is less subject to cold fracture at low temperatures, e.g. at −40° C., thus allowing use of the packaging for transport in winter conditions.

The lower portion of the overpack, namely the hollow cylindrical body 13, comprises an outer and an inner cylindrical shell. Each includes a cylindrical side wall, 53 and 55, respectively, the outer wall 53 being of thicker metal than the inner, since it is exposed to direct impact, and a circular bottom wall, 57 and 59, respectively, welded to the lower edge of the cylindrical wall, the outer wall 57 again being thicker than the inner. The outer side wall 53 is of greater axial extent than the inner wall and the outer circular bottom wall 57 of greater diameter than the inner wall 59, and the inner and outer shells are located relative to one another so that a space is defined between them.

Figure 5:
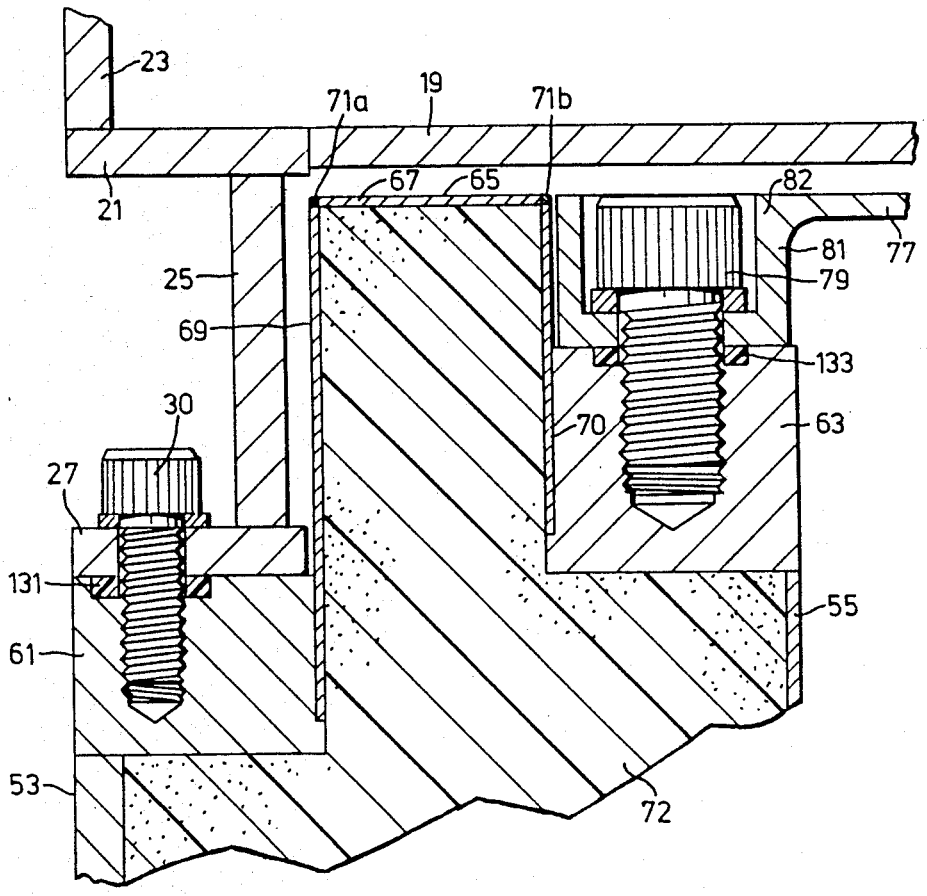
FIG. 5 is a cross section on a further enlarged scale of the area circled at 5 in FIG. 2.

As best seen in FIG. 5 the upper edges of the side walls 53 and 55 are welded to relatively heavy and substantially rigid beam-like ring members 61 and 63, respectively, each of rectangular cross section and each with an axial and a transverse dimension, as seen in the cross section of FIG. 5 which is in each case greater than the thickness of the wall 53 or 55 to which the ring is welded. As explained in more detail later, these ring members constitute rigid reference members, providing reference surfaces to which the surface of a jig or the like can be attached in order to position the outer and inner side walls 53 and 55 accurately concentric with one another.

Extending between and welded at each end to the ring members 61 and 63 is an annular cap member 65 which preferably, as shown is of relatively thin metal relative to the inner and outer walls 53 and 55 and of inverted channel sections having a planar annular top plate 67 and depending concentric cylindrical members forming depending limbs 69 and 70 welded to the mutually adjacent faces of the ring members 61 and 63, respectively, and the plate 67 at welds **71*a* and 71*b*. The thin metal cap member 65 offers the advantage that it is relatively flexible as compared with the walls 53 and 55 and therefore bends in the event of an impact on the outer wall 53 and does not transmit stresses applied to the outer or to the inner wall 53 or 55. Being of thin metal, the member 65 does not readily conduct heat to the interior of the overpack in the event of the exterior of the overpack being exposed to a fire. Since the member 65 extends upwardly inwardly of the depending flange 25, it further forms a heat transmission barrier reducing transmission of heat radially inwardly from the lower outer edge of the lid 15. The cap member 65, however, offers sufficient rigidity that it will withstand the low stresses applied during manufacture and will retain the side walls 53 and 55 accurately concentric during manufacture after the member 65 is welded to the ring members 61 and 63**, as described in more detail later.

As seen in the drawings, the interior space of the lid 15, of the plug 39 and within the side and bottom wall of the cylindrical body 13 are filled with heat insulative filler material 72. Although a large number of insulative materials are usable for filling the spaces, desirably, for ease of working, the filler material is rigid resin foam, more preferably a rigid polyurethane foam because of its excellent rigidity and heat resisting and insulative properties. Such foams are formed by introducing into the space a liquid precursor of the foam, which is allowed to foam and gel. The compositions of suitable liquid precursors and the foaming and gelling thereof are matters well known to those skilled in the art and need not be described in detail here. It is necessary to provide the shell with an opening or openings through which the liquid can be introduced and which can then be tightly sealed with a metal plug. An example of a plugged opening is shown in FIG. 4. Prior to assembly of the lid shell, a backing disc **73*a*, having an opening coincident with the resin introduction opening in the wall 17, is welded to the back surface of the wall 17. After pouring and gelling of the foam, a reduced diameter stem of a plug 75*a* is threaded into the opening in the wall 17 and disc 73*a*** which are correspondingly threaded.

In the preferred form, the ring members 61 and 63 are offset axially from one another. In the event of an impact on the outer surface of the overpack, the foam 72 absorbs the force transmitted to the outer wall 17, 45 or 53 by crushing to some extent. Beyond a certain point, however, the foam is crushed to form a solid force transmitting mass. Offsetting the ring 63 from the ring 61 has the advantage that on solid compaction of the foam 72 therebetween, radially inwardly directed forces applied on the outer ring 61 are not transmitted direct to the inner ring 63. Desirably, the inner ring 63 is offset upwardly relative to the outer ring 61.

A further advantage of the arrangement as shown is that on dropping of or impacting of the overpack on its upper corner, the force is absorbed by crushing of the foam 72 within the outer edge of the lid 15, and the studs 30 or the like securing the lid 15 to the body 13 are sheltered within an annular recess defined between the rim 21 and flanges 25 and 27, and are not acted on directly by forces which could tend to shear off the studs 30 or the like.

An internal circular lid 77, providing a further barrier to leakage is provided within the overpack and is secured to the inner ring 63 by threaded studs 79 passed through counterbores 81 spaced apart at intervals in a solid rectangular section rim 82 of the lid 77 and into threaded bores in the ring 63. The circular lid 77 has a central circular opening 83 bordered by a heavy ring 85 in which are received threaded studs 87 for securing releasably a circular cover plate 89.

Beneath the lid and disposed within the inner wall 55 of the overpack is the inner cask or vessel 91 having a cylindrical side wall 93 at a small clearance from the inner side wall 55 of the overpack, a circular exterior bottom wall 95 welded to side wall 93 and normally seating on the inner bottom wall 59 of the overpack, and a circular upper side 97 welded to the upper edge of the wall 93. The upper side 97 has a circular opening therein bounded by a heavy ring 99 to which is secured, by threaded studs 101, a circular closure plate 103. In normal use, the closure plate 103 is maintained secured to the upper side 97. After removal of the plug 39 and the cover plate 89, access is had to a port 105 in the closure plate 103, normally closed by a cap 107, through which liquids can be introduced into or discharged from the vessel 91. A vent port 109 normally closed by a similar cap 107 may be opened to allow displacement or ingress of air during liquid introduction or discharge.

In the preferred form, as shown, an interior bottom wall 111 is sealed, e.g. by welding, to the inner side of the wall 93, and is supported a small distance above and parallel to the exterior bottom wall 95 on spacers 113. The wall 111 has a circular opening 115 through it, the periphery of which is sealed to the inner side of the wall 95 by a welded in place sealing ring 117, thus defining a sump in the opening 115. A dip tube 119 connects to the port 105 and has one end disposed in the sump or opening 115, so that substantially all liquid can be withdrawn from the vessel by withdrawal up the tube 119. This allows substantially complete emptying of the vessel without needing to separate it from its overpack and without needing to use valves on the lower side of the vessel or overpack which would tend to be sheared off in the event of impact on the overpack.

In use, the overpack 11 with the vessel 91 and lid 77 therein will normally be supported in upright position on a transporter vehicle, e.g. on the well of a single drop gooseneck trailer pulled by a road tractor vehicle. The vessel 91 will remain within the overpack 11 at all times, access to the liquid filling and removal port 107 being had through the openings 31 and 83, after removal of the plug 39 and plate 89, at the nuclear generating station where tritium-free heavy water is discharged and tritium contaminated heavy water is loaded, and at the tritium removal facility where the contaminated heavy water is discharged and decontaminated heavy water is loaded.

As will be apparent to those skilled in the art from the above-detailed description referring to the accompanying drawings, the structure comprising the heavy rigid rings 61 and 63 provide distinct advantages in the fabrication of the overpack with its inner and outer cylindrical walls accurately concentric.

In one preferred form of a fabrication method taking advantage of the rigid support offered by the rings 61 and 63, the inner portion of the overpack shell comprising ring 63 with cylindrical member 70 and walls 55 and 59 in welded connection thereto as described above, and the outer portion of the shell, comprising ring 61 with cylindrical member 69 and walls 53 and 57 in welded connection thereto, are fabricated as two separate assemblies. The annular top plate 67 of the annular cap is loosely positioned on the upper edges of the cylindrical members 69 and 70, and the two assemblies are then suspended from a reference support structure in the form of a jig which has accurately dimensioned and disposed annular reference surfaces which correspond in position with the upper surfaces of the ring members 61 and 63 in the desired final body 13. The portions of the jig providing the said reference surfaces are connected together rigidly by an array of rigid, radially disposed, uniformly circumferentially spaced arms, these arms each curving arcuately upwardly from the outer reference portion of the jig to the inner reference portion in order to accommodate the upstanding cylindrical wall members 69 and 70 and the annular plate 67. The reference portions of the jig are provided with openings similar to the openings in the flange 27 and in the rim 81 of the lid 77, and the two assemblies are secured to these portions using the sets of threaded studs 30 and 79, respectively, which act as connectors thereby suspending the inner and outer assemblies accurately concentric with one another. The annular top plate 67 is then welded to the wall members at the annular weld lines **71*a* and 71*b* thus more firmly connecting the inner and outer shells together. The forming of the final welded connection between the annular cap 65 and the rings 61 and 63 after the suspension of the inner and outer assemblies allows for adjustment of the positions of the assemblies to align these with the reference surfaces of the jig and provide for accurate concentricity of the walls 53 and 55**.

Following the completion of the shell and rigidification of the shell structure by welding of the plate 67 to the members 69 and 70, the entire shell is inverted, employing conventional lifting equipment connected to anchor points (not shown) on the side 53 and bottom 57 of the overpack body 11.

Figure 2:
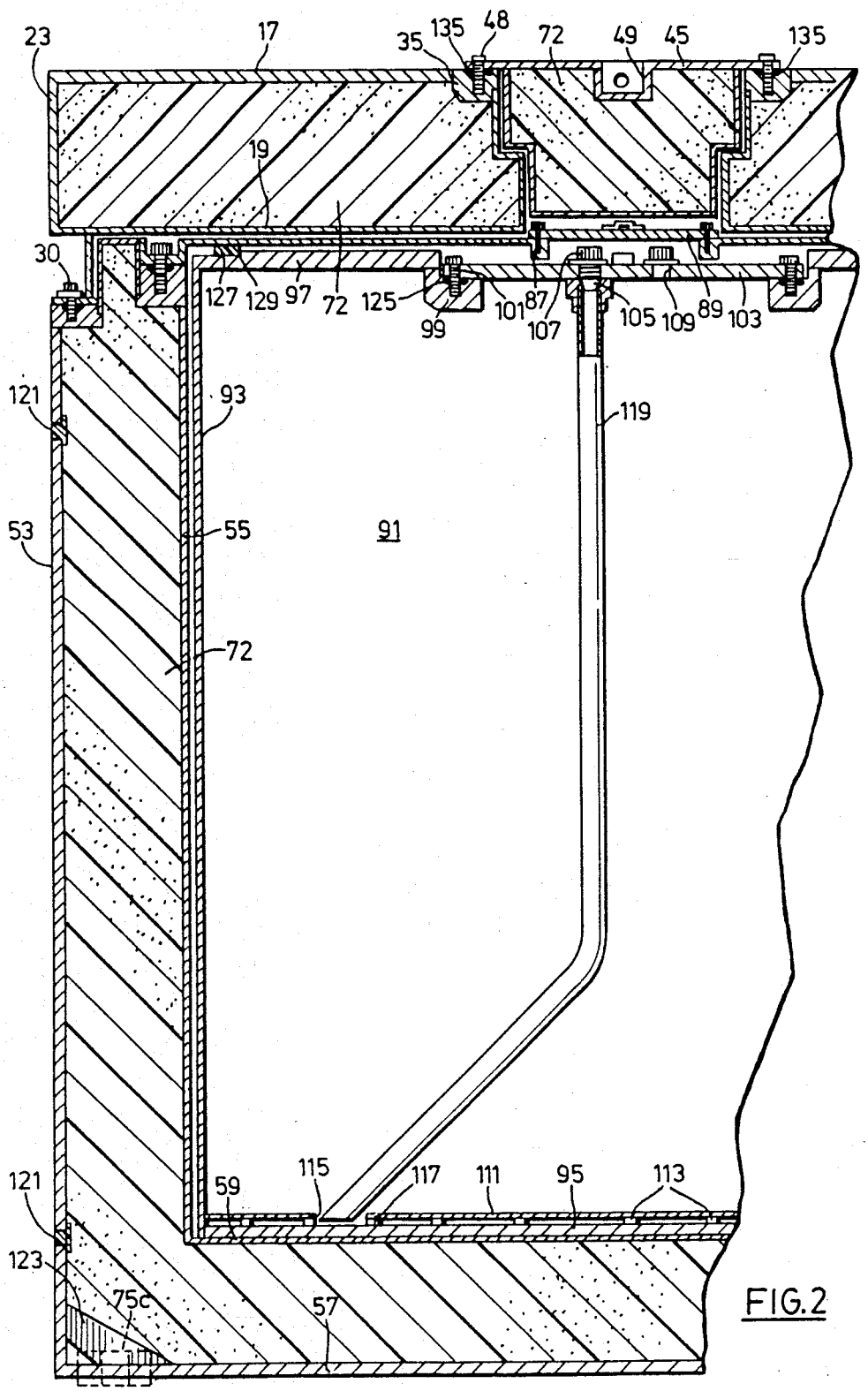
FIG. 2 shows a partial cross section taken through a packaging comprising the overpack, an inner vessel and an inner lid.
Figure 3:
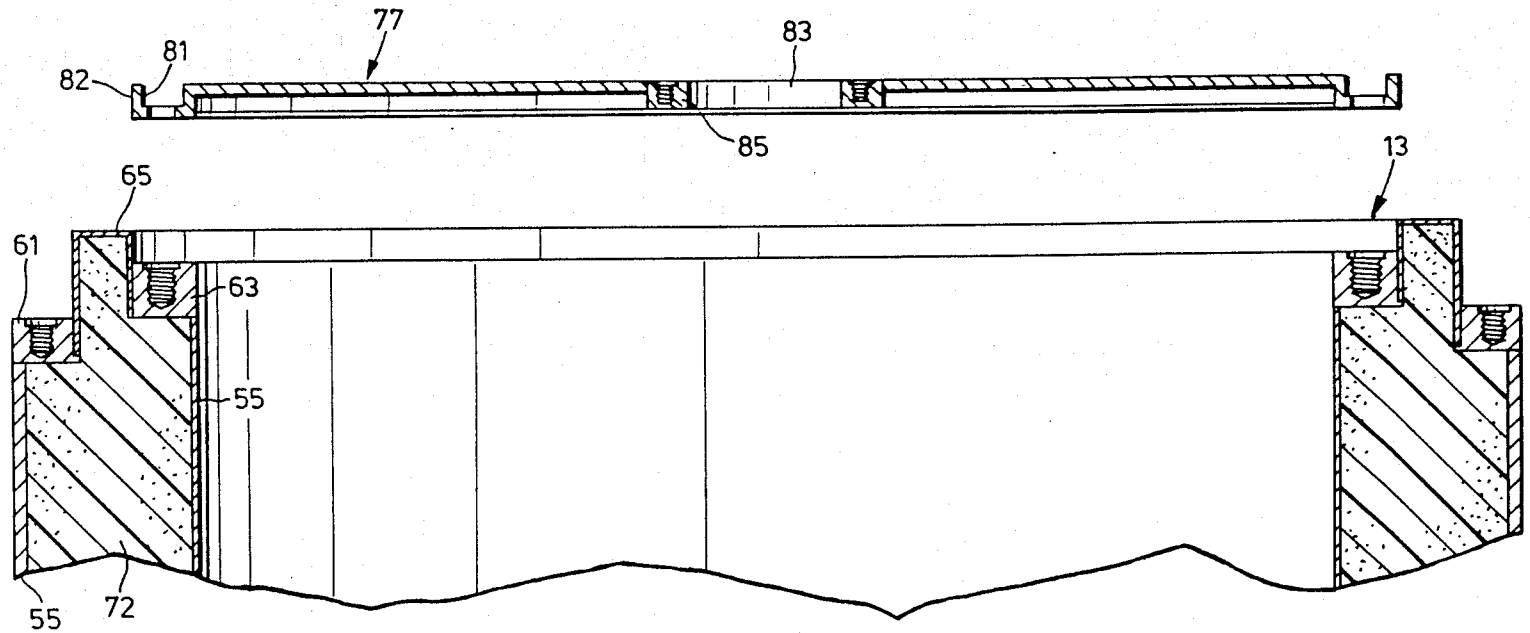
FIG. 3 is a cross section on an enlarged scale through the upper portions of the cylindrical hollow body of the overpack and the inner lid thereof.

Liquid precursor of the polyurethane or other found material is then introduced through openings in the sides 53 or bottom wall 57 until the space within the hollow shell is completely filled with formed and gelled material. The flow openings used for introduction of the foam material are then tightly closed. In FIG. 2 is shown, by way of example, in broken lines a plug **75*c* closing an opening in the bottom wall 57**.

The filling of the lid 15 with foam or the like proceeds generally in the manner described above, the foam precursor being introduced through an opening or openings in the wall of the shell of the lid after the welding together of the walls 17, 19, 21 and 23, and the opening or openings being closed with a plug such as the plug **75*a*** in the manner described above.

It will be appreciated that the welded outer shells defined around the filler material 72 constituting the inner core of the lid 15, plug 39 and body 13 are continuous and watertight and thus prevent absorption of any spill of liquid by the porous fill 72 and contamination thereof.

FIG. 2 shows also small plastic plugs 121 which are threaded into small openings in the wall 53. In the event of exposure to strong heating, these melt to provide small vent openings allowing venting of gaseous degradation products of the resin foam fill 72. Also shown are fillet plates 123 welded to the interior corner surfaces of the outer side and bottom walls 53 and 57 at intervals in order to provide increased rigidity.

In order to provide a tighter liquid-tight seal between the interior of the vessel 91 and the surroundings, annular resiliently compressible gaskets, e.g. of silicone elastomer or the like, may be provided at various points.

An annular gasket 125 may be provided in an annular channel in the upper side of the heavy ring 99, compressed between the ring 99 and the plate 103. An annular gasket 127 may be compressed between the upper side 97 of the vessel and the inner lid 77, the gasket 127 being held under tension by an outwardly extending step or shoulder 129 on the upper side 97. Further annular gaskets 131 and 133 may be received in respective channels in the upper sides of the rings 61 and 63 and compressed between the rings and the flange 27 and the rim 81, respectively. A further annular gasket 135 may be received in an annular channel in the ring 35 in the upper wall 17 of the lid 15, and is compressed between the ring 35 and the edge of the plate 45 of the plug 39.

I claim:

1. A cylindrical overpack for protection of a vessel for holding radioactive or like hazardous materials during transport, comprising a circular lid having an upper and a lower circular wall, a cylindrical edge member welded at its upper and lower ends to the upper and lower walls, respectively, and heat insulative filler material disposed in the space therebetween, and a cylindrical hollow body on which the lid is secured, having concentric inner and outer cylindrical walls defining an annular space therebetween, with said outer wall of greater axial extent than said inner wall and an inner and an outer circular bottom wall welded to the lower edges of inner and outer cylindrical walls, respectively, and with said outer bottom wall offset downwardly from the inner bottom wall to define a lower space therebetween, outer and inner concentric substantially rigid ring members welded to an upper edge of the outer and of the inner cylindrical walls, respectively, and each of a rectangular cross section of axial and transverse dimension each greater than the wall thickness of the cylindrical wall to which it is welded, an annular cap member extending between and welded at its opposite edges to said outer and inner ring members, respectively, and heat insulative filler material disposed in said annular and lower spaces.

2. An overpack as claimed in claim 1 wherein said cap member is of sheet metal of wall thickness substantially less than the wall thickness of each of said inner and outer cylindrical walls.

3. An overpack as claimed in claim 2 wherein said cap member is of inverted channel section.

4. An overpack as claimed in claim 1 wherein one of said ring members is offset axially with respect to the other.

5. An overpack as claimed in claim 5 wherein the inner ring member is offset axially upwardly with respect to the outer.

6. An overpack as claimed in claim 1 wherein said lid has a cylindrical flange depending downwardly from the lower circular wall thereof and inset radially inwardly from the edge thereof, an annular flange extending radially outwardly from the cylindrical flange and seating on the outer ring of said body, and releasable connector means connecting the annular flange to said outer ring.

7. An overpack as claimed in claim 6 wherein said annular cap is of inverted channel section and extends upwardly inwardly of said depending cylindrical flange.

8. An overpack as claimed in claim 1 wherein the filler material is rigid resin foam.

9. An overpack as claimed in claim 1 wherein said lid has a central generally cylindrical opening therethrough normally closed by a generally cylindrical plug having a welded metal shell filled with heat insulative fill material.

10. In combination, an overpack as claimed in claim 9 and a cylindrical vessel disposed within said cylindrical hollow body and having a port in the upper side of the vessel accessible on removal of the cylindrical plug from the overpack lid for introducing liquid into and removing liquid from the vessel.

11. The combination as claimed in claim 10 wherein the vessel has an exterior bottom wall welded to a lower edge of a side wall thereof, an interior bottom wall parallel to and disposed inwardly of the exterior bottom wall, an opening in the interior bottom wall, sealing means disposed between the interior and exterior bottom walls around the opening to define a sump in said opening, and a dip tube having one end connected to said port and the opposite end disposed in said sump.

12. The combination as claimed in claim 10 including a horizontally extending circular metal inner lid having its edge secured to the inner ring member of the cylindrical body of the overpack, a central aperture in the inner lid exposing said port on removal of said cylindrical plug, and a cover plate releasably secured to the inner lid and normally closing the aperture.

13. Method of fabrication of an overpack comprising: fabricating a circular lid shell by welding the edges of a cylindrical edge member to the edges of an upper and a lower circular wall, respectively, and introducing into the space within said lid shell a liquid precursor of a rigid resin foam through an opening in the shell, allowing the precursor to foam and gel and sealing said opening; and fabricating a cylindrical hollow body by fabricating an inner and an outer cylindrical shell each having a cylindrical wall welded at its upper edge to a substantially rigid ring member of rectangular cross section of axial and transverse dimension each greater than the wall thickness of the cylindrical wall to which it is welded, and a circular bottom wall welded to the lower edge of the cylindrical wall, the ring member and the circular bottom wall of the inner shell being of smaller diameter than those of the outer shell and the cylindrical wall of the inner shell being of smaller axial extent than that of the outer shell, suspending the inner shell concentric with the outer shell by attachment of connection means to the inner and outer rings, welding an annular cap between the inner and outer rings of said inner and outer shells to provide a cylindrical hollow body assembly, inverting the hollow body assembly so that the annular cap is at the lower end thereof, introducing into the space between the inner and outer shells, through an opening in the outer shell adjacent the upper end and remote from said cap, a liquid precursor of a rigid resin foam, allowing the precursor to foam and gel, and sealing said opening.

* * * * *